United States Patent [19]

Hoffman

[11] 4,330,238

[45] May 18, 1982

[54] AUTOMATIC ACTUATOR FOR VARIABLE SPEED PUMP

[75] Inventor: Clark R. Hoffman, Oxnard, Calif.

[73] Assignee: The United States of America as represented by the Secretary of the Navy, Washington, D.C.

[21] Appl. No.: 127,020

[22] Filed: Mar. 4, 1980

[51] Int. Cl.[3] ..... F04B 49/00

[52] U.S. Cl. ..... 417/19; 417/34; 417/45

[58] Field of Search ..... 417/42–47, 417/15, 18–20, 34, 36, 38

[56] References Cited

U.S. PATENT DOCUMENTS

| | | | |
|---|---|---|---|
| 1,633,786 | 6/1927 | Horter | 417/19 |
| 2,224,295 | 12/1940 | Hofer | 417/19 |
| 2,439,239 | 4/1948 | Crever | 417/43 |
| 2,440,981 | 5/1948 | Smith | 417/20 |
| 2,634,681 | 4/1953 | Rowell | 417/34 |
| 2,651,995 | 9/1953 | Blackburn | 417/19 X |
| 2,989,000 | 6/1961 | Alcaro | 417/19 |
| 3,072,058 | 1/1963 | Christopher et al. | 417/19 |
| 4,139,332 | 2/1979 | Cantrell et al. | 417/34 |

*Primary Examiner*—Carlton R. Croyle
*Assistant Examiner*—Edward Look
*Attorney, Agent, or Firm*—Robert F. Beers; J. M. St. Amand

[57] ABSTRACT

An automatic speed-control actuator for variable speed pumps. A rotary or linear actuator changes the pump speed to prevent unacceptably low pressures on the pump inlet or unacceptably high pressures on the pump outlet; pressure switches at these locations control the actuator to produce maximum flow rates through the pump.

13 Claims, 1 Drawing Figure

AUTOMATIC ACTUATOR FOR VARIABLE SPEED PUMP

BACKGROUND OF THE INVENTION

This invention relates to fuel pumps and particularly to an automatic speed-control actuator for variable speed pumps.

Controls for the automatic regulation of fuel distribution pumps are not readily available on the market. Standard controls presently available would require extensive and expensive modifications involving considerable electronic circuitry to be capable of performing required functions provided by the instant invention.

The primary purpose of the control of this invention is to automatically regulate pump speed under varying inlet conditions to achieve a maximum pumping rate while not exceeding a selected pump discharge pressure or creating an excessive vacuum at the pump suction. This novel control is applicable to booster pumps operating with a positive pressure on both the inlet and outlet, and to lift pumps, where limiting the suction and discharge pressures is desired. The control of this invention will accomplish these results in a manner which is less costly and simpler to install and maintain than others presently available.

Old methods for pumping fuels, etc., over long distances usually necessitated shuttling fuel from one station to another requiring reservoirs, observers or operators to check on fuel supplies and communications from one pumping station to the next. However, with the present system, pumps can be connected in series and operate automatically, as described herein, without the need for reservoirs at each pump station, operators, etc.

U.S. Pat. No. 2,225,295 discloses an automatic control system for a suction dredge pump which actuates through the medium of a switch unit arranged in combination with a flow or velocity meter connected in communication with the discharge pipe of the pump. This control regulates the motor speed to maintain a constant flow velocity in the pump discharge and to stop the pump if there is no flow. The control of the present invention, however, regulates engine speed by monitoring the suction side of the pump as well as the discharge side and will regulate the engine speed to produce as near a vacuum as the inlet setting of the control will allow; in addition, the present invention will maintain a constant pressure on the discharge side of a pump even when there is no flow, and is designed for automatic operation of pumps in series as well as single pumps.

U.S. Pat. No. 2,651,995 relates to an automatic booster station for a pipe line pumping system which operates automatically and is responsive to changes in the rate flow of pipe line fluids; the system is provided with interlocking safety features to prevent damage in the event that any dangerous conditions are encountered. This device, however, utilizes a centrifugal switch attached to a flow meter to start and stop a pump; it does not adjust pump speed to compensate for changing flow conditions in the pipeline as is provided by the instant invention. The pressure switches used in this prior art patent are merely emergency safety switches.

U.S. Pat. No. 2,989,000 discloses a control designed to maintain a preset differential pressure across a pump. Whereas, the control of the present invention is to maintain a minimum suction pressure and/or a maximum discharge pressure, and any differential which occurs within these set limits is acceptable; if either suction or discharge pressure exceeds the set limits the present control device will slowly lower the engine speed looking for a point where the suction and discharge pressure conditions are acceptable, and if none is found the engine will run at a fixed idle until the pressure requirements are satisfied, at which time the pump will automatically resume normal operation. In the patented device, the control must be manually returned to normal operation following a low pressure shutdown.

In U.S. Pat. No. 3,072,058, a control system is disclosed for a pipe line pumping station having at least one pump driven by an electric motor by way of a variable mechanical coupling. The control used in this prior system monitors the power consumption of an electrically driven pump motor and regulates the pumping rate so as not to exceed an electrical power demand factor. The objective in this prior patent is to minimize power cost and is not related to changing speed to prevent unacceptable pressure changes as in the instant invention.

SUMMARY OF THE INVENTION

In the instant invention, the control regulates the pump speed to deliver a maximum flow without full time attention by an operator. A rotary or linear actuator is used to change the pump speed to prevent unacceptably low pressures on the pump inlet or unacceptably high pressures on the pump outlet. Pressure operated switches at the inlet and outlet to the pump control the actuator to produce maximum flow rates through the pump.

DESCRIPTION OF THE PREFERRED EMBODIMENT

Figure 1:
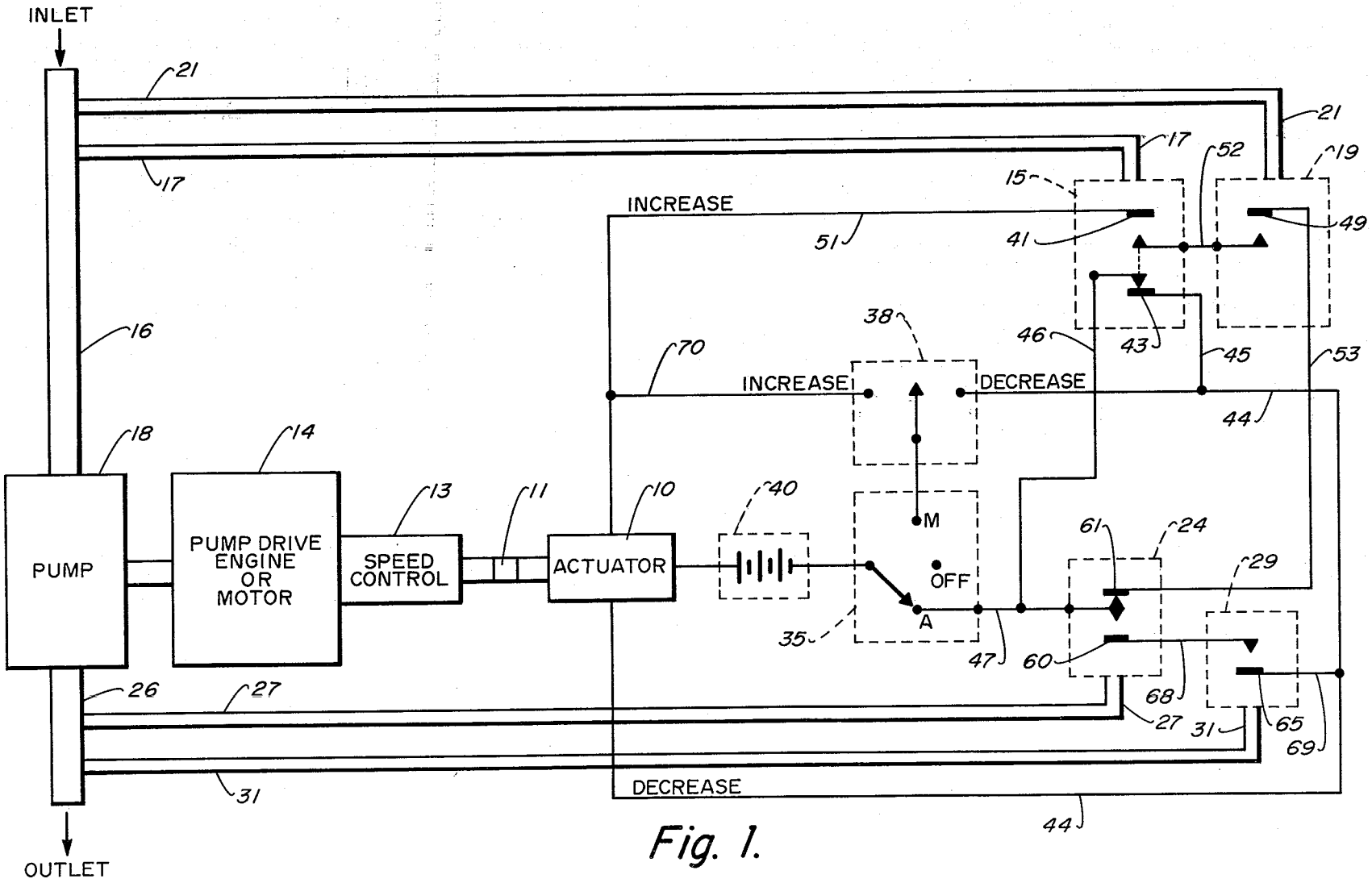
FIG. 1 is a schematic diagram of a preferred embodiment of the pump control unit of the present invention.

The pump control of this invention is suitable for use with all types of pumps having variable speed drives. This includes electric drive, internal combustion engine drive, or any other type of drive where speed of the drive unit can be changed through a rotary or linear motion, for example. FIG. 1 schematically illustrates the control of the present invention, and basically consists of an actuator and six switches, as shown.

Actuator 10 is a reversible electric rotary or linear actuator equipped with limit switches and an electric break if required to lock its position. The actuator is mechanically linked at 11 to the speed adjusting mechanism 13 of the pump drive motor or engine 14.

A first switch 15 is a double-pole pressure operated switch with one electrical contact normally in the open position and one electrical contact normally in the closed position. Switch 15 is connected to the suction side (i.e., inlet 16) of the pump 18 via pressure line 17 and set to operate at 5 p.s.i.g., for example.

Switch 19 is a single-pole single-throw pressure operated switch with normally open contacts; this switch is connected to inlet 16 of pump 18 via pressure line 21 and is set to operate at about 15 p.s.i.g., for example.

A single-pole double-throw pressure operated switch 24 is connected to the discharge side (i.e., outlet 26) of pump 18 via line 27 for severing outlet pressure and is set to operate at about 10 p.s.i. less than the maximum allowable operating pressure; for example, at a setting of 120 p.s.i.g.

Switch 29 is a single-pole switch with one set of normally open contacts, as shown, and is connected to be responsive to pressure at outlet 26 of pump 18 via pressure line 31. This switch is set to operate at a maximum allowable operating pressure of 130 p.s.i.g., for example.

Single-pole double-throw switch 35 has a center "off" position and is used to select manual "M" or automatic "A" operation of the actuator, or "off" condition. Switch 38 is a single-pole double-throw switch, spring loaded on both sides with a center "off" position, and is used to manually select an increase or decrease in the actuator position for varying the speed control in a like manner.

Operation of the control is identical for both booster pump and lift pump application and will differ only in the setting of pressure switches 15 and 19 which sense the pressure at the pump inlet via lines 17 and 21. In describing the operation, a booster pump will be considered in which the flow and pressure to the pump inlet is variable. The pressure head against which the pump is discharging can also be varying.

For automatic operation, the pump drive engine or motor 14 is started manually driving pump 18 via the drive shaft connecting the two units and selector switch 35 is placed in the automatic position "A". With no liquid flow or pressure reaching pump 18 at inlet 16, all pressure switches will be in their normal positions, as shown in FIG. 1, which results in a decrease-speed signal from power supply 40 to actuator 10 causing the engine to run at idle. At some time, when liquid flow from an upstream source reaches the pump, pressure will increase at the pump inlet 16. When the pressure reaches the preset 5 p.s.i.g., switch 15 will actuate (i.e., making contact at 41 and breaking contact at 43) and the signal from power supply 40 driving actuator 10 to the decrease-speed position, via lines 44, 45, 46 and 47, will be removed. When the inlet pressure increases to the 15 p.s.i.g. setting, switch 19 will actuate (i.e., make contact at 49). This in turn will close the increase-speed circuit, via lines 51, 52, 53, 47 and power supply 40, and signal the actuator 10 to increase engine speed at a slow rate. As the engine speed increases, the pumping rate and discharge (i.e., outlet) pressure will increase, and the inlet pressure will decrease. If there is an adequate flow of fluid to inlet 16, the outlet pressure will rise and at the preselected pressure setting of 120 p.s.i.g. switch 24 will operate (i.e., make contact at 60 and break contact at 61) to remove the increase-speed signal from the actuator. In this condition, pump 18 will continue to pump fluid at the 120 p.s.i.g. discharge pressure so long as the flow of fluid to inlet 16 remains unchanged. If some event occurs, either upstream or downstream, which causes an increase in the discharge pressure to the preset 130 p.s.i., pressure, switch 29 will operate (i.e., make contact at 65). This will energize actuator 10, via lines 68, 69, 44 and power supply 40, to decrease the speed which in turn will decrease the pump discharge pressure at outlet 26. When the pressure drops below the 130 p.s.i.g. setting, switch 29 will open again holding the throttle in that position. If the event, either upstream or downstream, causes a decrease in discharge pressure below the pressure set for switch 24, the actuator will increase the throttle setting. In this way the control will modulate between the 120 and 130 p.s.i.g. settings, for example, being controlled by switches 24 and 29.

In a similar manner, if an event, either upstream or downstream, from pump 18 causes an insufficiency of fluid at the pump inlet 16, the inlet pressure will drop causing, first, switch 19 to open which will prevent any increase in throttle position. Then if the pressure drops below 5 p.s.i.g., switch 15 will return to normal position causing actuator 10 to decrease the throttle position until the pressure again rises above 5 p.s.i.g., at which point the control will modulate on suction (i.e., inlet) pressure.

When manual operation of the throttle is desired, switch 35 is placed in the manual position "M" and the actuator run up or down (i.e., increase or decrease) manually by means of the spring loaded switch 38, via power supply 40 and lines 70 and 44, respectively, Construction and operation has been described using electrically powered components. However, hydraulic or pneumatic controls can also be used with appropriate pressure transducers 51 and 52 connected to pressure lines 17 and 21, respectively at the pump inlet and pressure transducers 54 and 55 connected to pressure lines 27 and 31, respectively, at the pump outlet.

Obviously, may modifications and variations of the present invention are possible in the light of the above teachings. It is therefore to be understood that within the scope of the appended claims the invention may be practiced otherwise than as specifically described.

What is claimed is:

1. An automatic speed-control actuator system for variable-speed fluid pumps operable to change the pump speed for preventing unacceptable low pressures at a pump inlet and unacceptable high pressures at a pump outlet, comprising:

a. a pump means having an inlet and an outlet;

b. a drive means connected to said pump means for driving said pump means;

c. a speed adjusting means in conjuction with said drive means for varying the speed of said drive means;

d. an actuator means connected to said speed adjusting means and being operable to vary said speed adjusting means for any of increasing, decreasing, and idling the speed of said drive means and thus the flow of liquid through said pump means;

e. a power source;

f. switching means sensitive to and actuated by present pressures at the inlet and at the outlet of said pump means; said switching means comprising;

a circuit including first, second, third, and fourth pressure-actuated switches;

said pressure-actuated switches being arranged in said circuit such that in their normal unactuated positions a decrease-speed signal is applied from said power source to said actuator means for causing said drive means to run at an idling speed;

said first pressure-actuated switch being operable to be actuated to cause said decrease-speed signal from said power source to said actuator means to be removed when pressure at said inlet reaches a first preset pressure;

said second pressure-actuated switch being operable to be actuated when pressure at said inlet reaches a second preset pressure, which is greater than said first preset pressure, to cause an increase-speed signal from said power source to be applied to said actuator means for increasing the drive means speed at a slow rate;

said third pressure-actuated switch being operable to be actuated to remove said increase-speed signal applied to said actuator from said power source when the outlet pressure increases to a desired third preset pressure, which is greater than said second preset pressure, allowing said pump means to continue to operate and discharge fluid at the third preset pressure as long as fluid flow to said inlet is unchanged;

said fourth pressure-actuated switch being actuated by an increase in pressure at said outlet to a fourth preset pressure causing a decrease-speed signal from said power source to be applied to said actuator means and in turn cause a decrease in pressure at said outlet until said fourth pressure-actuated switch deactuates; a decrease in pressure below said third present pressure causing said third pressure-actuated switch to deactivate and again apply an increase-speed signal to said actuator means, thus causing said actuator control system to modulate between said third and fourth preset pressures by control of said third and fourth pressure-actuated switches;

said first pressure-actuated switch being deactivated when an insufficiency of fluid at said inlet causes a pressure drop below said first preset pressure thus preventing any increase-speed signal from being applied to said actuator means and causing a decrease-speed signal to be applied until the pressure rises above said first preset pressure at which point said actuator control system will modulate on inlet pressure;

g. said switching means connected to said actuator means and to said power source for applying signals from said power source to said actuator means to vary said speed adjusting means and thereby cause said pump means to change its pumping rate in response to pressure conditions at said pump means inlet and outlet for maintaining normal pumping operations under pressure conditions between a minimum preset suction pressure at said inlet and a maximum preset discharge pressure at said outlet; said pump means speed being automatically regulated under varying inlet conditions to achieve a maximum pumping rate while not exceeding selected discharge pressures at the outlet and not creating an excessive vacuum at the inlet.

2. A system as in claim 1 wherein means is provided for manual control of said actuator means.

3. A system as in claim 2 wherein said means for manual control comprises an operator switch means for selecting manual control, automatic control, and off positions, and includes additional switch means for manually applying increase-speed signals and decrease-speed signals to said actuator means.

4. A system as in claim 1 wherein said actuator means is a reversible electric actuator equipped with limits and electric break.

5. A system as in claim 1 wherein said first and second pressure-actuated switches are pressure line connected to said inlet, and said second and third pressure-actuated switches are pressure line connected to said outlet for directly sensing the respective pressures at said inlet and said outlet.

6. A system as in claim 1 wherein said first pressure-actuated switch is a double-pole electrical switch with one electrical contact normally in open position and one electrical contact normally in closed position.

7. A system as in claim 1 wherein said second pressure-actuated switch is a single throw electrical switch with normally open contacts.

8. A system as in claim 1 wherein said third pressure-actuated switch is a single-pole double-throw electrical switch with one electrical contact normally in closed position.

9. A system as in claim 1 wherein said fourth pressure-actuated switch is a single-pole electrical switch with normally open contacts.

10. A system as in claim 1 wherein electrically powered components are used.

11. A system as in claim 1 wherein said switching means is hydraulically powered and uses pressure sensing transducers at said inlet and outlet.

12. A system as in claim 1 wherein said switching means is pneumatically powered and uses pressure sensing transducers at said inlet and outlet.

13. A system as in claim 1 wherein said pump means and drive means operates at a set idle speed until the minimum preset suction pressure at said inlet is sensed by said switching means, at which time said pump means and drive means will automatically resume normal pumping operations.

* * * * *